US006452200B1

(12) United States Patent
Kotler

(10) Patent No.: US 6,452,200 B1
(45) Date of Patent: Sep. 17, 2002

(54) GAP SHIELDED CONTAINER FOR A RADIOACTIVE SOURCE

(75) Inventor: Jiri G. Kotler, Nepean (CA)

(73) Assignee: MDS Nordion Inc., Kanata (CA)

( * ) Notice: Subject to any disclaimer, the term of this patent is extended or adjusted under 35 U.S.C. 154(b) by 0 days.

(21) Appl. No.: 09/311,605

(22) Filed: May 13, 1999

(51) Int. Cl.[7] ..... G21F 5/04
(52) U.S. Cl. ..... 250/506.1; 250/497.1
(58) Field of Search ..... 250/506.1, 505.1, 250/507.1, 515.1, 496.1, 497.1, 498.1; 376/272

(56) References Cited

U.S. PATENT DOCUMENTS

| | | | | |
|---|---|---|---|---|
| 3,132,998 A | | 5/1964 | Long et al. | |
| 4,437,578 A | | 3/1984 | Bienek et al. | |
| 4,582,638 A | * | 4/1986 | Homer et al. | 252/633 |
| 4,585,946 A | | 4/1986 | Snyder | |
| 4,594,214 A | | 6/1986 | Popp et al. | |
| 4,825,088 A | | 4/1989 | Nair et al. | |
| 4,893,022 A | | 1/1990 | Hall et al. | |
| 5,042,679 A | | 8/1991 | Crowson et al. | |
| 5,134,295 A | | 7/1992 | Walischmiller | |
| 5,276,335 A | * | 1/1994 | Shinopulos et al. | 250/506.1 |
| 5,504,344 A | | 4/1996 | Stein et al. | |

FOREIGN PATENT DOCUMENTS

CA 2174272 4/1996

OTHER PUBLICATIONS

Nordion International, Inc., Product Information Pamphlet, Gammacell ®220, High Dose Rate Research Irradiator, Mar. 1989.

Nordion International, Inc., F–168 Transport Packaging, Drawing No. F–168, Rev. AC, Jan. 1991.

* cited by examiner

*Primary Examiner*—Kiet T. Nguyen
(74) *Attorney, Agent, or Firm*—Brink Hofer Gilson & Lione

(57) ABSTRACT

The invention relates to a container for a radioactive source, having reduced radiation leakage from a gap between movable housing components. The container comprises a housing having a bore extending into the housing. A removable cylindrical sleeve having a chamber therein is inserted into the bore. Two co-operating helices are present; the first helix is located on a surface of the housing facing into the bore, and the second helix is located on the sleeve. The co-operating helices block the gap between the housing and the sleeve when the sleeve is inserted into the bore, thereby attenuating the radiation emanating from the gap when a radioactive source is housed within the container. Axial rotation of the sleeve within the bore results in movement of the sleeve between a withdrawn position and an inserted position within the housing.

17 Claims, 10 Drawing Sheets

GAP SHIELDED CONTAINER FOR A RADIOACTIVE SOURCE

The present invention relates to containers for housing radioactive material.

BACKGROUND OF THE INVENTION

Containers for housing a source of radioactive material are conventionally formed of thick walls made of a shielding material. In some containers, access to the interior of the container employs the use of a tightly fitting removable closure. However, radiation can leak through the gap between the walls and the closure in quantities adequate to present a hazard to the safety of workers in the vicinity of the container.

The Gammacell™ irradiator (MDS Nordion, Kanata, Canada) is an example of a container housing a radioactive source, specifically cobalt 60, at a level of up to 24,000 curies. The irradiator unit is self-shielded, and thus can be installed in a laboratory setting without any further site shielding requirements. The principal use of this irradiator unit is in research and development of applications where high radiation doses are required. Typical applications include development of radiation resistant plastic materials, determination of doses required for sterilization of disposable medical products, and calibration of dosimetry systems.

A conventional irradiator, such as the Gammacell™, utilizes a radioactive source arranged in an annular ring around a central vertical bore within a lead-shielded housing. A cylindrical sleeve comprising a top and bottom drawer and a sample chamber located between the top and bottom drawer is movably located within the central vertical bore along a longitudinal axis. The top and bottom drawer are formed of a shielding material in order to prevent radiation leakage from the bore. The sleeve is capable of movement within the bore in a direction parallel to the longitudinal axis, so that the sample chamber is either in a withdrawn position with respect to the housing where a sample may be loaded into the chamber, or in an inserted position with respect to the housing, whereby the sample chamber is exposed to the radiation source.

To irradiate a sample, the sleeve is first adjusted to the withdrawn position so that the sample chamber is accessible above the housing. A lead shielding collar is opened to allow insertion of a sample into the sample chamber. The collar is then closed and the sample delivery assembly is lowered into the inserted position so that the sample chamber is horizontally aligned with the radiation source.

When in the inserted position the sleeve provides a significant amount of radiation shielding. In order for the sleeve to slide freely in a direction parallel to the longitudinal axis, a gap is present within the bore between the sleeve and the side of the housing facing into the bore. Thus, a worker may be exposed to radiation escaping through this gap and exiting the irradiator unit in the region of the opened shielding collar at the top of the housing.

The disadvantage of the conventional irradiator design is that, due to the position of the radiation source with respect to the gap, radiation emanates through the gap with only minimal scatter. However, the more scattered the radiation is, the less energetic and less hazardous it becomes. Depending on the size of this gap in conventional irradiator units, and its variation with manufacturing tolerances, the radiation fields outside the irradiator, both at the top and the bottom of the unit, can be significant. Measurements of radiation emanating from a conventional irradiator unit indicate that the typical intensity of the radiation beam on the outside of the unit ranges between 500 to 1000 mR/hour (subject to the type of instrumentation used). During installation of a conventional irradiator unit it is estimated that radiation exposure to the hands of the user, from gaps in the unit, ranges between 20 to 200 mrem. While there have been efforts to reduce exposure by minimizing the width of this gap, any further reduction would impede the intended operation of the unit, and could make movement of the sleeve within the bore difficult.

An analogous device is disclosed in U.S. Pat. No. 5,134,295 which is directed to an irradiation apparatus having a source of radiation disposed within a housing, and a chamber for receiving a sample to be irradiated. The housing is closed by means of a removable plug. When a sample is to be irradiated, a valve is opened between the chamber and the radiation source, and the source may then be moved up to irradiate the sample within the chamber. However, escape of radiation from the gap formed at the interface of the housing and the removable plug is not addressed.

The above-discussed prior art relates to removable sleeve assemblies within an irradiator unit, typically comprising a radiation source stored in the irradiator housing, not within the removable sleeve. However, containers for transporting radioactive materials may also comprise a shielded container having a removable closure within which a radioactive source is placed. In the case of such a container, the removable closure acts as a seal for the source and may also provide shielding along with the walls of the container. However, a similar problem as described above with reference to the irradiator unit, exists with containers so configured, in that a gap exists between the removable closure and the walls of the container.

A variety of removable closures have been used in containers for shielding and sealing radioactive material disposed within a central bore of the container. Such closures include containers comprising two lids of different diameters that screw into two threaded portions of the container, for example, U.S. Pat. Nos. 4,893,022; 4,825,088 and 4,595,214. U.S. Pat. No. 4,585,946 is directed to a container for use with radioactive materials wherein the materials are packaged under water. This container provides means for the drainage of water using compressed gas while providing shielding of the radioactive material. U.S. Pat. Nos. 5,042,679 and 4,437,578 disclose containers for storing or transporting radioactive material, and provide a threaded closure as well as gas-tight sealing means.

U.S. Pat. No. 3,132,998 describes a channel shield for use with nuclear reactors. The channels to be shielded are those which allow access to fuel rods within the reactor. To shield a channel, a tubular plug having helical ribs is disposed within the channel. The ribs come into contact with the inner surface of the channel to reduce or eliminate radioactive leakage. However, this plug seals against the wall of the channel, and there is no corresponding structure (e.g. mating groves on the inner channel surface) with which the plug interfaces. The ribs cause scatter and absorption of the radiation emanating from the reactor, thereby reducing radiation leakage from a channel. However, a linear gap still exists where the ribs of the plug contact the corresponding ribs on the inner surface of the channel.

U.S. Pat. No. 5,504,344 describes a radiation shield for use in containers housing a radioactive source. The shield is used to minimize passage of radiation through the gap between a container housing and a closure. The shield involves complementary interdigitating ridges formed on adjacent container components. The ridges may be peaked, rectangular or curved in shape. The interdigitating surfaces of the adjacent components attenuates the amount of radioactivity escaping from the gap between them. However, an uninterrupted upward gap exists at the interface of the interdigitating surfaces, through which radiation may still emanate. Also, once the closure is removed to access the container interior, radiation leakage occurs. However, there is no discussion of the shielding of the gap region of such a container.

The present invention provides a container which obviates or mitigates one or more of the above-noted deficiencies of the prior art. Thus, the invention is directed to a container that attenuates leakage of ionizing radiation from the radioactive source housed therein. The invention provides a radiation shielded container having a removable sleeve and a shielded housing so that the leakage of radioactivity from the gap between the closure and the housing is attenuated, to thereby eliminate or reduce the safety hazard presented to a worker in the vicinity of the container.

SUMMARY OF THE INVENTION

According to the invention, there is provided a container for accommodating a radioactive source comprising a shielded housing having a bore extending therein and a removable sleeve adapted for insertion into the bore. The sleeve has a longitudinal axis, and the housing and the sleeve define a gap formed therebetween when the sleeve is inserted into the bore. A first helix is located on a surface of the housing facing into the bore and a second helix located on the sleeve. The first helix mates with the second helix, thereby attenuating leakage of radiation from the container through the gap when a radioactive source is accommodated therein.

Advantageously, the mating helices provide shielding material within the gap between the housing and the sleeve. The helices thus serve to scatter and attenuate the radiation to which a worker may be exposed in the vicinity of the gap, and reduces overall radiation dose received by a worker when in close proximity to the container.

BRIEF DESCRIPTION OF THE DRAWINGS

These and other features of the invention will become more apparent from the following description in which reference is made to the appended drawings wherein.

DESCRIPTION OF PREFERRED EMBODIMENTS

The present invention relates to a container for a radiation source. With reference to FIGS. 1 to 10, embodiments of the invention will now be described in further detail as relating specifically to use in an irradiator unit and in a storage and transport container.

Figure 4:
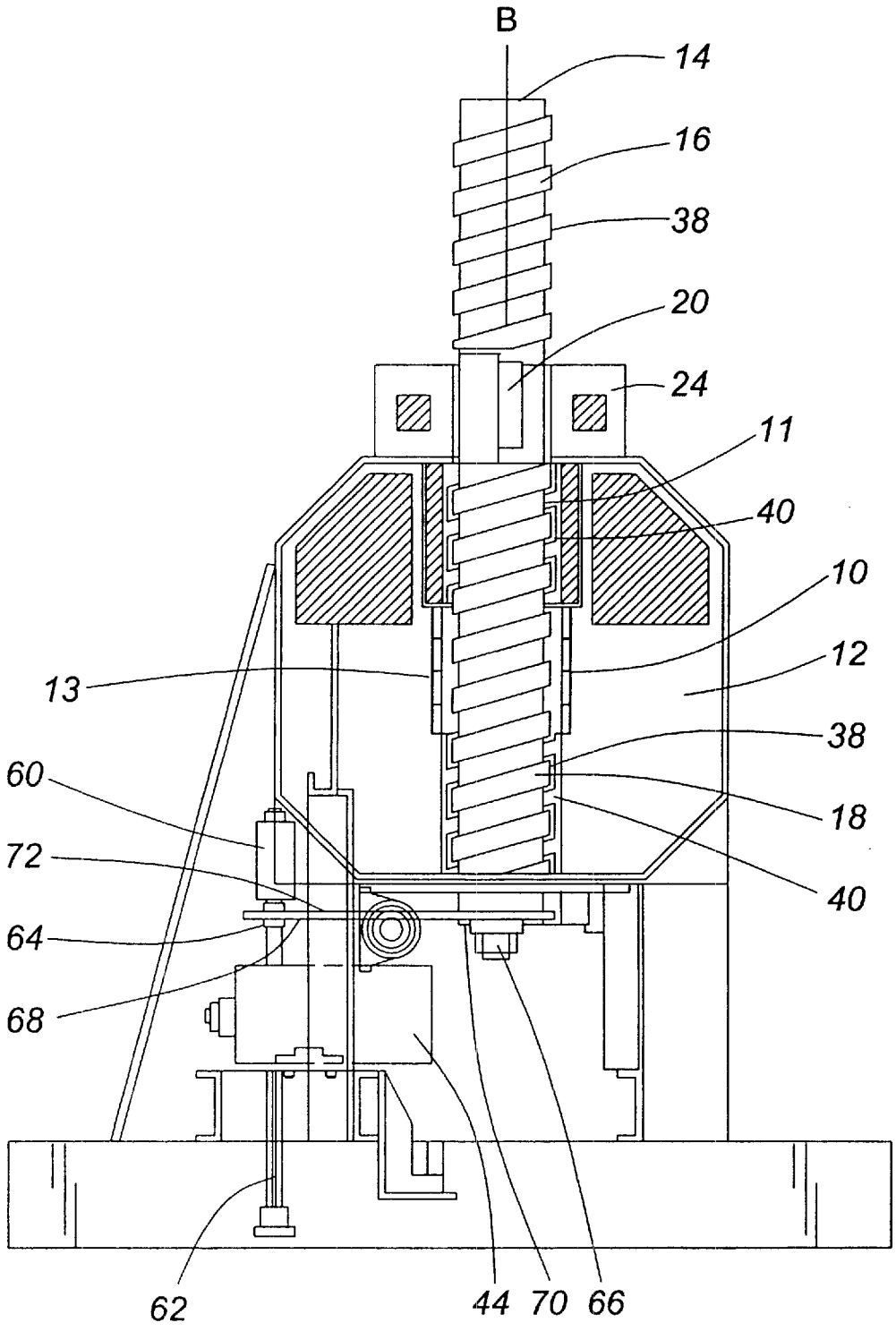
FIG. 4 is a sectional side view of an irradiator unit according to an embodiment of the invention in a withdrawn position.
Figure 5:
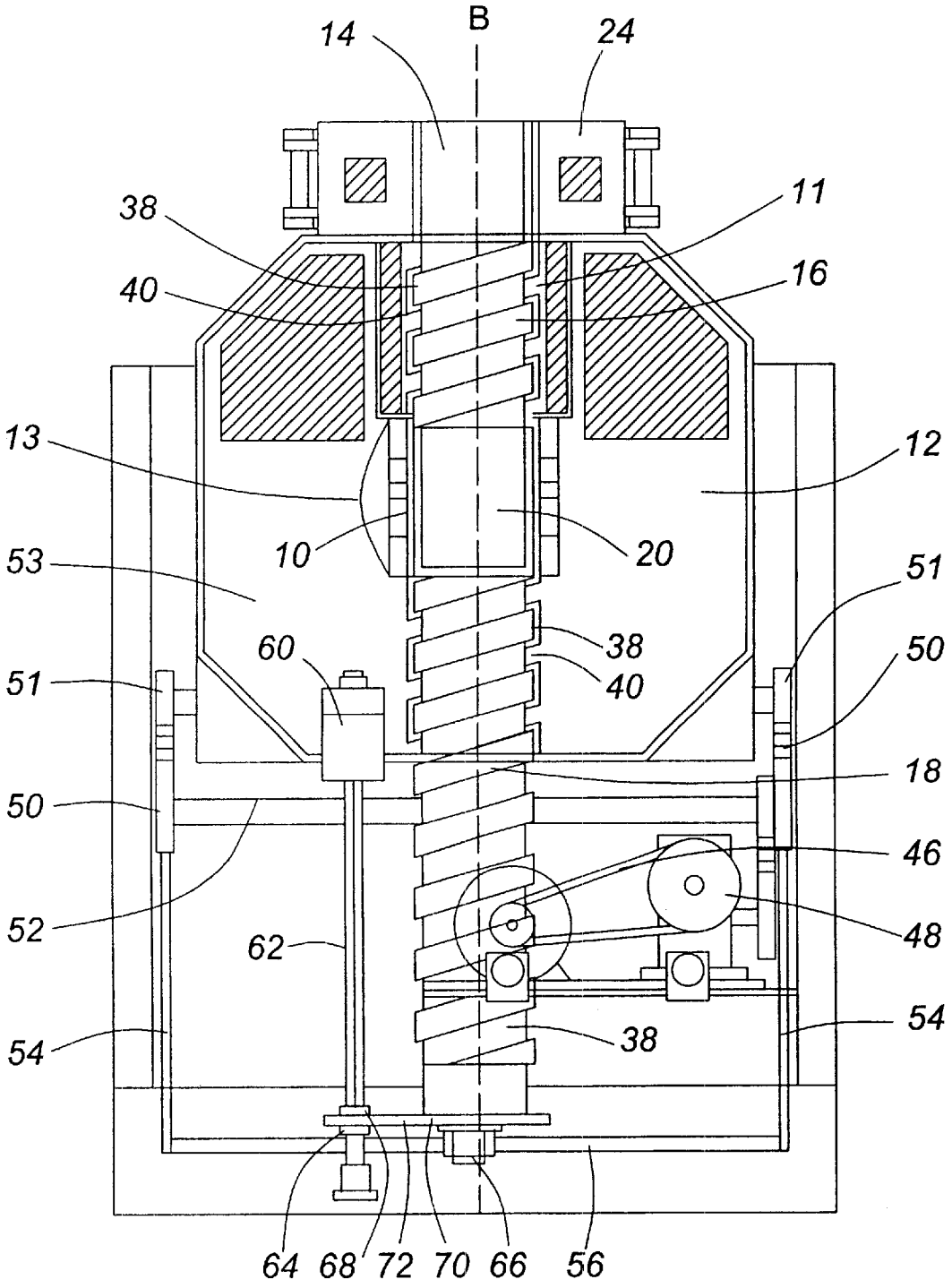
FIG. 5 is a sectional front view of the embodiment of FIG. 4 in an inserted position.
Figure 8:
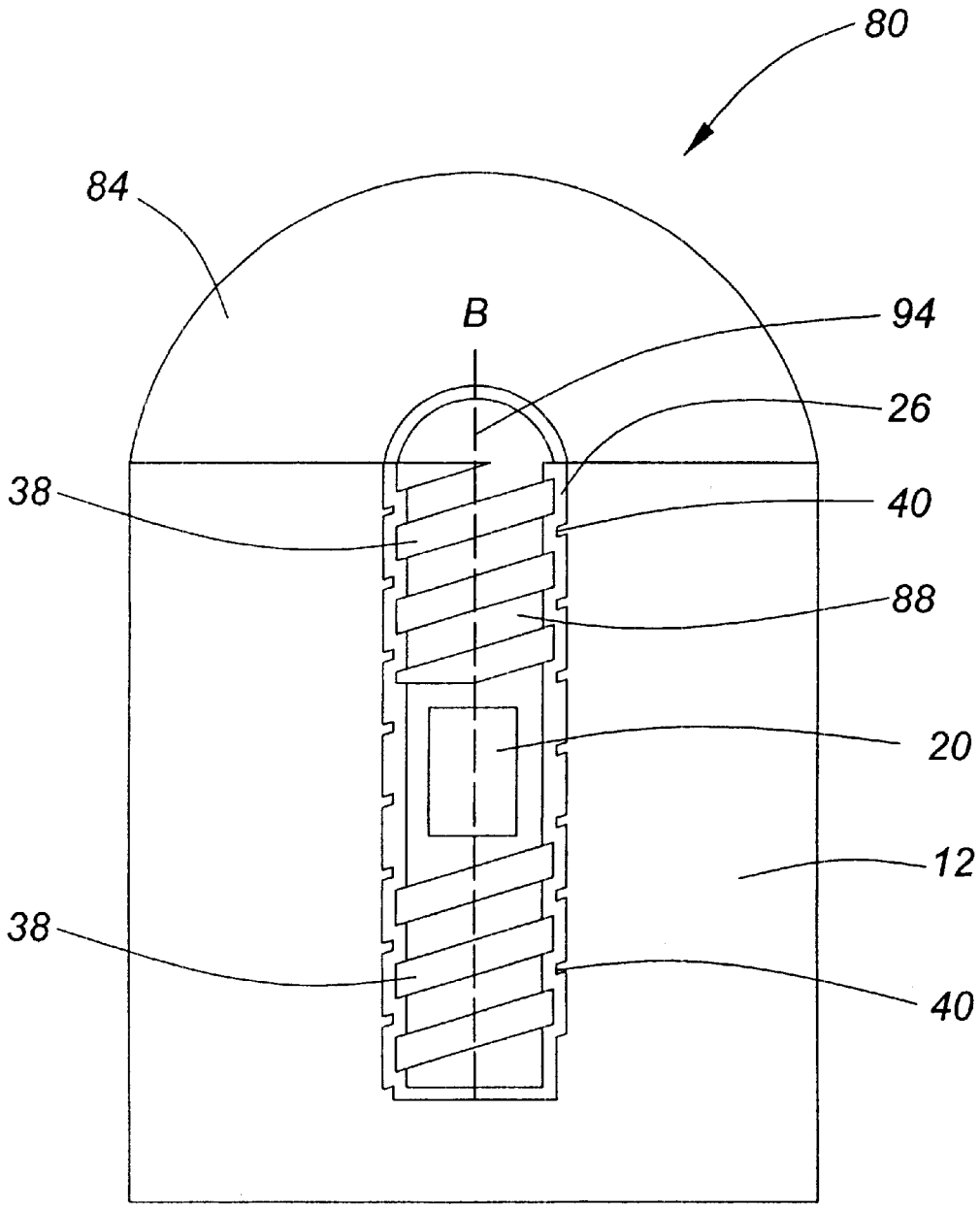
FIG. 8 is a sectional front view of a storage and transport container according to an embodiment of the invention, in an inserted position.
Figure 9:
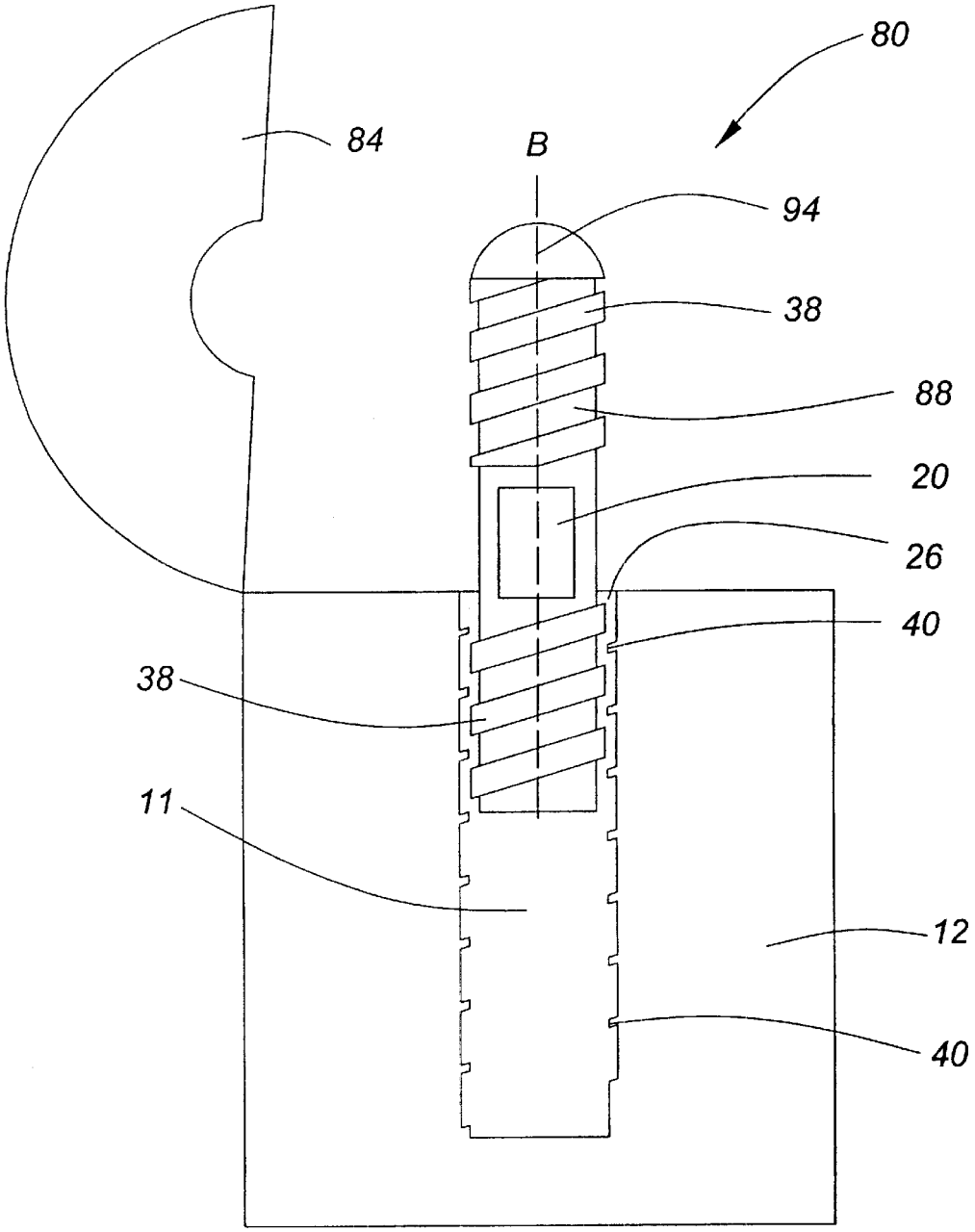
FIG. 9 is a sectional front view of the embodiment of FIG. 8 in a withdrawn position.
Figure 10:
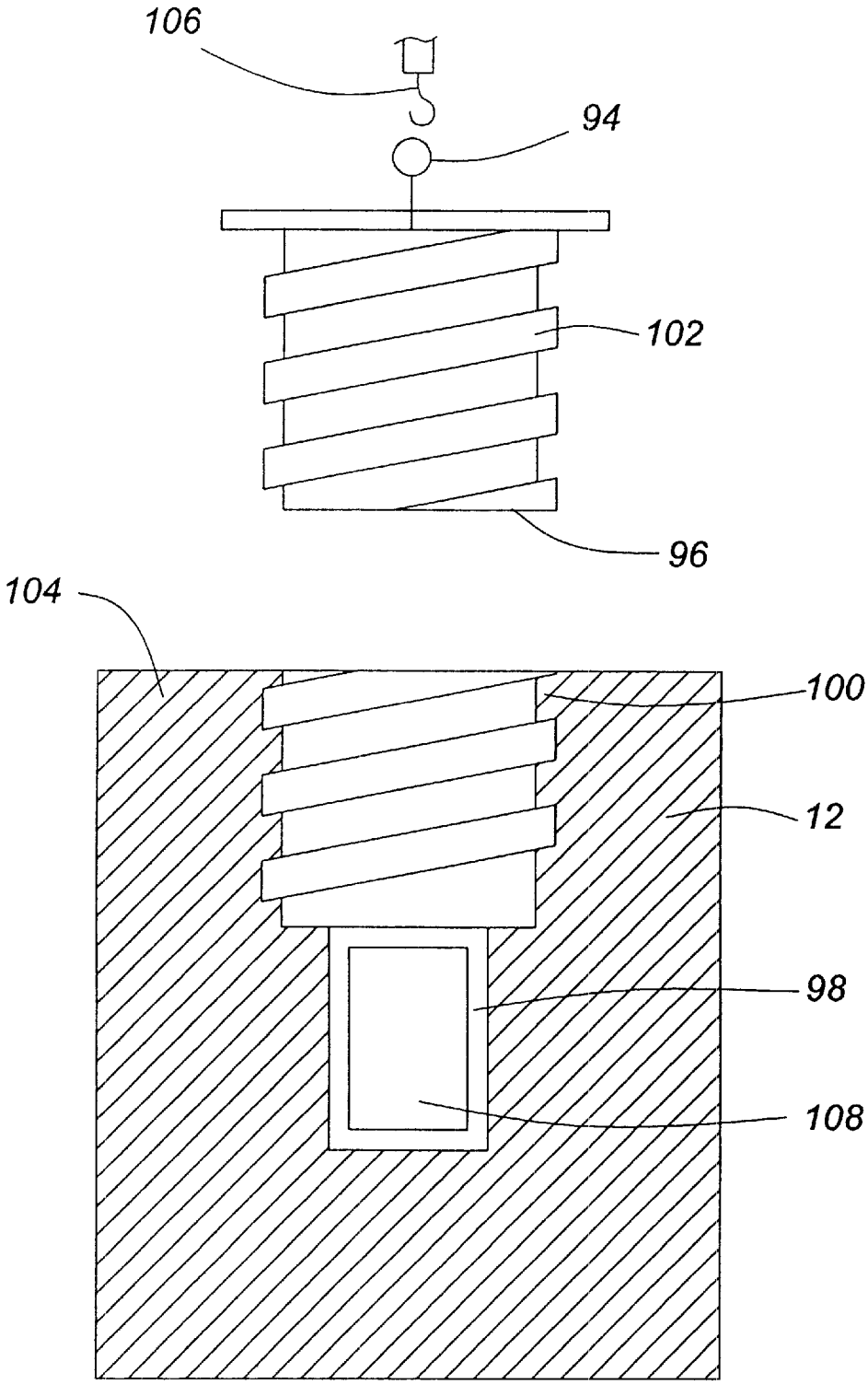
FIG. 10 is a sectional front view of the an alternate embodiment of a transport and storage container of the present invention.

According to the invention, the container comprises a shielded housing (12) with a central bore (11) extending therethrough. A cylindrically shaped removable sleeve is disposed within the bore. The sleeve may be a sample delivery assembly (14) as depicted in FIGS. 4 and 5, a source delivery assembly (88) as depicted in FIGS. 8 to 10, or a removable plug, depending on the intended use of the container. The container may retain a radioactive source (10) within the housing and located at the periphery of an expanded region (13) of the bore, or within a chamber (20) formed in the removable sleeve.

If the radioactive source is to be located within the housing at the periphery of the expanded region (13) of the bore (11), the radioactive source can either be single point source, or a plurality of sources, for example, arranged as an annular ring in the expanded region (13) of the bore (11). For example, the container may be adapted to receive rods comprising cobalt 60 ($^{60}Co$) or other suitable radioisotope, in an annular ring around the periphery of the expanded region (13) of the bore. An irradiator unit having a housing adapted to receive a radiation source in an annular ring is discussed below in further detail.

As an alternative to the annular ring configuration for the radiation source, the housing may be adapted to receive a point source of radiation within the bore, as depicted in FIGS. 8 to 10. In this configuration, a radiation source is typically housed within the removable sleeve, or source delivery assembly, so that the radiation source may be accessed when the sleeve is in the withdrawn position. A storage or transport container having such a configuration is discussed below in further detail with reference to FIGS. 8 to 10.

Any radioactive source can be housed in the container according to the invention. Depending on the intended application, the container may be of any acceptable size.

The container of the present invention also comprises mating helices which threadedly cooperate. One helix is integrally formed on the outside of the removable sleeve and the corresponding helix is formed on the surface of the bore of the housing.

These helices-engage within the gap between the sleeve and the housing to allow removal of the sleeve from the housing through axial rotation, while shielding radiation leaking from the gap.

The co-operating helices may be formed of any material suitable to attenuate or scatter radiation. For example but without being construed as limiting, the helices may be formed of metallic, ceramic, or polymeric materials. For example, metals such as lead or cooper alloys, or stainless steels may be used.

Irradiator Unit

According to one aspect of the invention, the container for a radioactive source may be an irradiator unit. A conventional Gammacell™ 220 irradiator unit is illustrated in prior art FIGS. 1 and 2 in the withdrawn position and inserted position, respectively. The Gammacell™ 220 is adapted to house a radioactive source (10), for example but not limited to $^{60}$Co, within a housing (12) which is radiation-shielded. The $^{60}$Co source (10) is arranged as rods in an annular ring around the periphery of an expanded region (13) of a central vertical bore (11).

Figure 1:
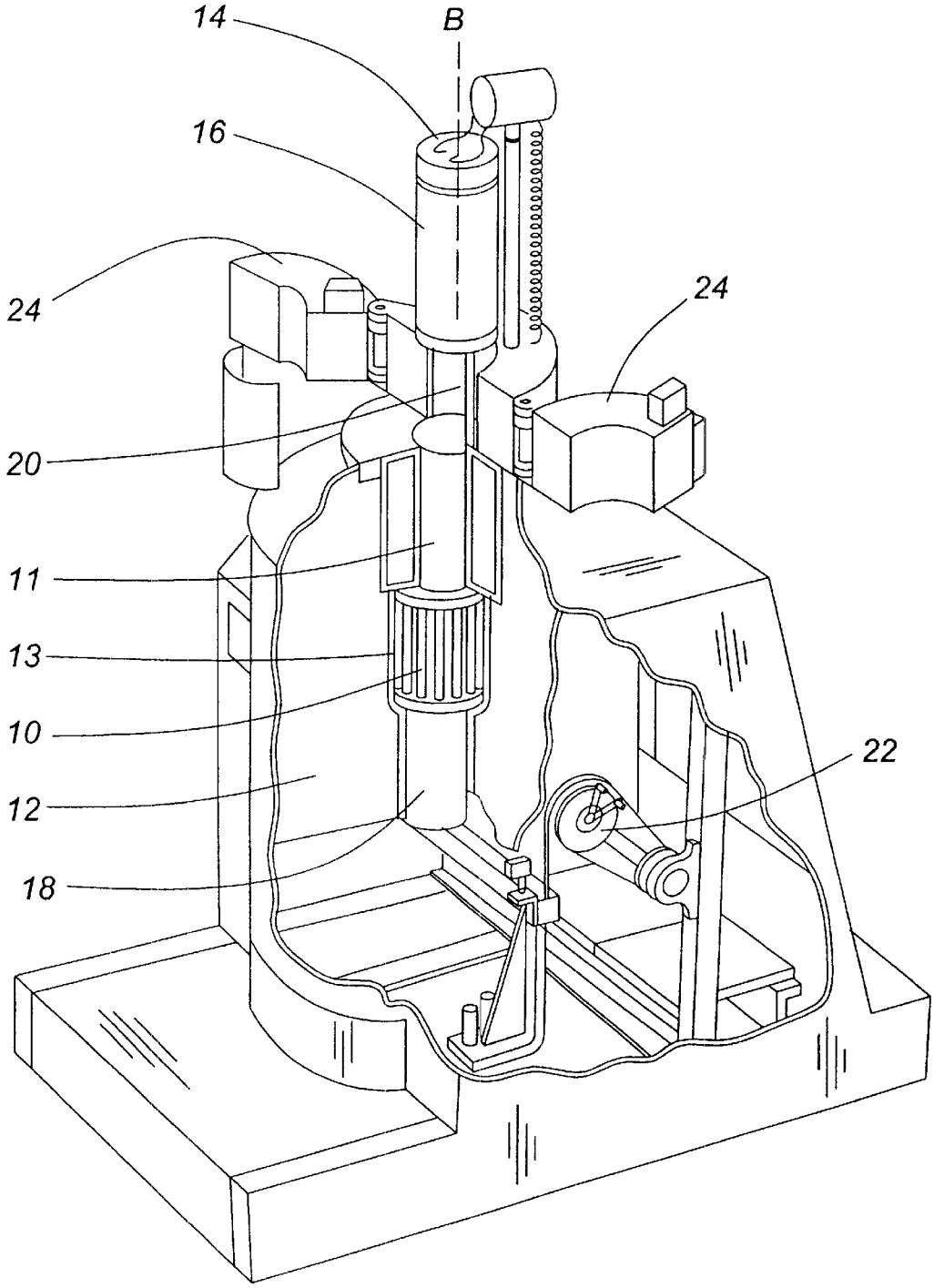
PRIOR ART FIG. 1
FIG. 1 depicts a cut-away perspective view of a PRIOR ART irradiator unit in a withdrawn position.

The removable sleeve of such a conventional irradiator unit is a sample delivery assembly (14; FIG. 1), typically having a top drawer (16), a bottom drawer (18), and a chamber (20) located between the top and bottom drawers. The top and bottom drawer are comprised of a shielding material to reduce radiation leakage from the bore, however, variations in this arrangement may exist, for example the sample delivery assembly may enter the housing along a horizontal plane within a horizontal bore.

Figure 2:
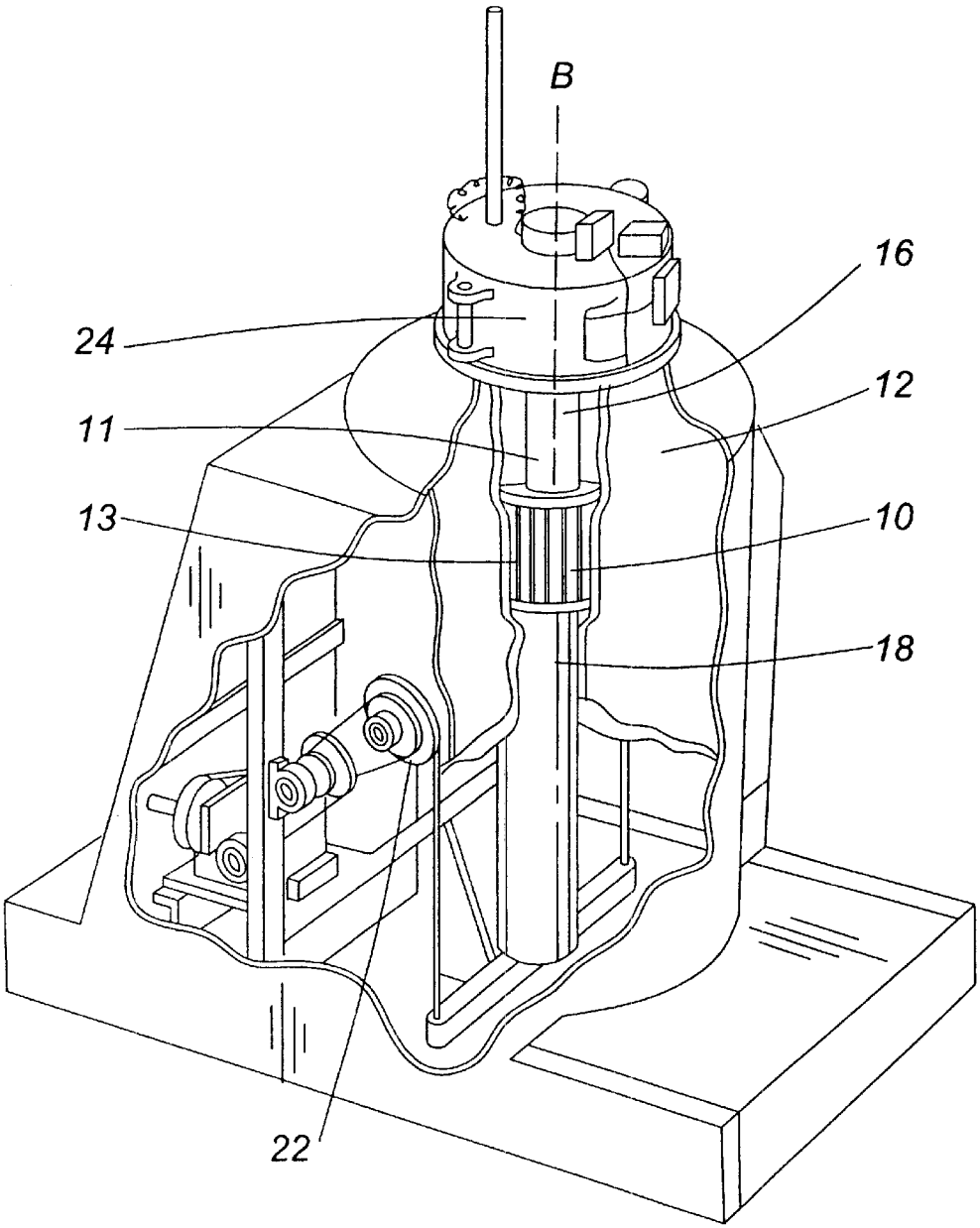
PRIOR ART FIG. 2
FIG. 2 depicts a cut-away perspective view of a PRIOR ART irradiator unit in an inserted position.
Figure 3:
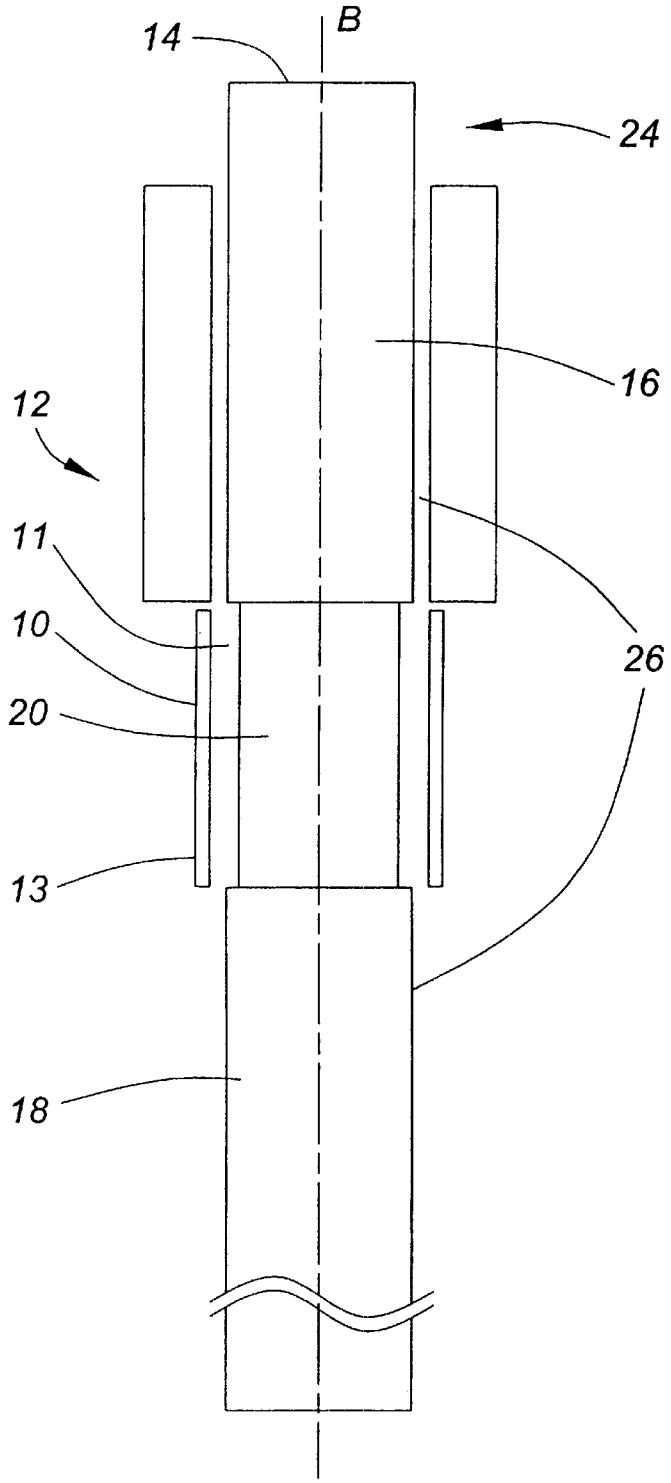
PRIOR ART FIG. 3
FIG. 3 is a schematic representation of a central bore of a PRIOR ART irradiator unit having gaps through which radiation can emanate.

The sample delivery assembly (14) has a longitudinal axis (B) and may be withdrawn or inserted within the bore of the housing in the direction of this axis using a suitable longitudinal drive means (22). FIG. 1 depicts the conventional irradiator unit in a withdrawn position, having the chamber (20) accessible from the outside of the housing (12), external of the bore (11), where the chamber can be loaded with a sample. FIG. 2 depicts the unit in an inserted position so that the chamber (20) is located within the housing (12) and is approximately aligned with the radiation source (10), to expose a sample in the chamber to radiation. A lead shielding collar (24) may be opened or closed to allow insertion of a sample into the chamber (20). The drawers (16 and 18), located on either side of the chamber (20) and aligned therewith in respect of the longitudinal axis (B), provide shielding to reduce radiation emanating from the source within the housing (12).

When the sample delivery assembly is in the inserted position, and the collar (24) is closed, a significant amount of radiation shielding is realized. However, in this conventional irradiator unit design, in order for the assembly to slide freely in a direction parallel to the longitudinal axis, a gap (26) exists between the sample delivery assembly (14) and the surface of the housing facing into the bore (11), as shown schematically in FIG. 3. Thus, a worker may be exposed to radiation escaping through this gap and exiting the apparatus in the region of the opened shielding collar.

Figure 6:
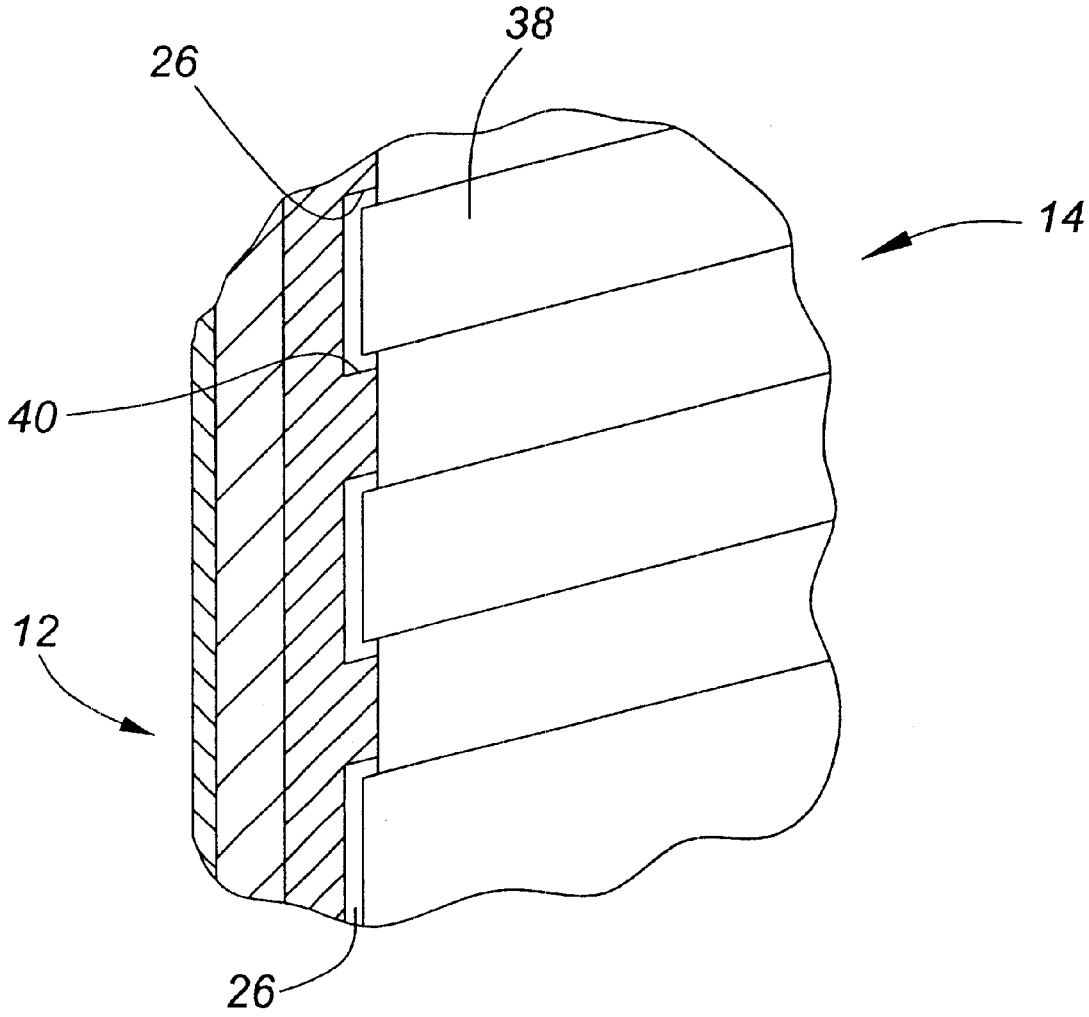
FIG. 6 is a partial sectional side view of region A of FIG. 4 illustrating first and second helices in a mating configuration.

An embodiment of the invention is illustrated with respect to an irradiator unit as depicted in FIGS. 4 to 6. In FIGS. 4 to 6, there is shown an irradiator unit having a housing (12) with a bore (11), a removable sleeve, which in this embodiment is a sample delivery assembly (14), comprising a top drawer (16), a bottom drawer (18) and a chamber (20) located between the top and bottom drawers. The sample delivery assembly (14) and the surface of the housing (12) facing into the bore (11) have mating helices (38, 40) disposed thereon which threadedly cooperate when axial rotation about the longitudinal axis (B) is imparted to the sample delivery assembly (14).

The profile of the mating helices may be any of a variety of suitable configurations that ensures a mating interaction between these two helices. For example, which are not to be considered limiting in any manner, the profile of the matingly interacting portions of the helices may be crenulate (e.g. "V" shaped), curved (e.g. "U" shaped), crenellated (e.g. "[" shaped) or the like. A first helix (38) is located on the sample delivery assembly (14) and a second helix (40) is located on the surface of the housing (12) facing in toward the bore (11), in regions both above and below the expanded region (13) of the bore adapted to house the radiation source (10). Thus, the helices (38, 40) place shielding material in the path of the radiation emanating from the radiation source (10) to increase the overall radiation scattering effect.

The helices may be continuous or discontinuous along the surfaces from which they extend. For example, as depicted in FIGS. 4 and 5, the first helix (38) is located on the sample delivery assembly (14) and may comprise a continuous helix or discrete helical regions above and below the chamber (20). The helical region of the first helix (38) located below the chamber (20) may also be continuous or comprise discrete helical regions. The second helix (40) located on the surface of the housing facing in toward the bore may be continuous or may comprise discrete helical regions, for example a helical region above the radiation source (10) and a helical region below the radiation source. The helices (38, 40) may be continuous or discontinuous, without altering their co-operativity. Thus, both continuous and discontinuous helices, or a combination having a continuous helix and a discontinuous helix are included as embodiments of the invention.

The helices may be formed integrally on the surface of the housing facing into the bore (11) and on the sample delivery assembly (14), respectively. In the embodiment represented in FIGS. 4 and 5, mating helices (38, 40) are located both above and below the radioactive source (10). The region of each helix located below the radioactive source could alternatively be omitted, if shielding of radiation emanating from the lower end of the container is not required. For example, if the container housing does not have a lower opening, which may be the case if the container is intended for a shipping or storage. Thus mating helical regions would not need to be located below the radioactive source.

The helices may be integrally formed on the respective surfaces, or alternatively may be affixed thereto, permanently, or non-permanently. The helices may be made of any effective radiation blocking material such as but not limited to metals, such as steel, cooper or lead-based alloys, ceramics, or polymeric materials, and each helix may be made of the same or of different materials. In order to avoid galling due to the friction of metal rubbing against metal, the mating helices could be formed of different materials, for example one helix may be formed of stainless steel, or a lead or cooper alloy, and the other of a ceramic or polymeric radiation-blocking material. The helices may be made of the same radiation blocking material as the housing and/or the sleeve, for example, the material forming the top drawer (16) and bottom drawer (18) of the sample delivery assembly (14) in FIGS. 4 and 5.

A plurality of helical turns are indicated in the embodiments of the invention depicted in FIGS. 4–6. However, the number of helical turns required may be more or less than the number indicated in this embodiment. At least one, and preferably two or more helical turns along the length of the sleeve, shown in FIGS. 1 and 5 as the sample delivery assembly (14), effectively shield the gap and permit the movement of the sleeve between the withdrawn and inserted positions within the housing.

According to the embodiment of the invention depicted in FIGS. 4 and 5, the movement of the sample delivery assembly (14), or sleeve, within the bore (11) is due to a combination of axial rotation and longitudinal movement in the direction of the longitudinal axis (B) of the sample delivery assembly (14). Longitudinal drive means may be used to impart longitudinal movement to the sleeve within the bore. For example, the longitudinal movement of the sleeve within the bore can be imparted using a drive motor and chain system. Any suitable drive means for imparting longitudinal movement to the sleeve within the bore may be used.

However, a longitudinal drive means is not necessarily required if the force applied by the rotation imparting means to achieve rotation of the sleeve is adequate to guide the mating helices in longitudinal movement as well as axial rotation. Advantageously, the irradiator unit embodiment of the invention comprises both a longitudinal drive means and rotation imparting means, so as to avoid undue stress on the helices or galling of the surfaces.

The drive mechanism of the Gammacell™ 220 may be used as the longitudinal drive means, as depicted in FIGS. 4 and 5. Briefly, this drive mechanism comprises a chain and sprocket system which acts to withdraw or insert the sample delivery assembly (14) into the bore (11). The power may be provided by a suitable motor, for example a 2 hp 220V, 3 phase motor (44), the output speed of which is reduced, for example through a V-belt (46) and pulley connection to a worm gear reducer (48). Further speed reduction may be obtained through a chain and sprocket drive system. For example, a lift sprocket (50) at each end of a drive shaft (52) transmits the shaft rotation to small end head sprockets (51) mounted each on side of the head base (53). The head sprockets rotate less than one revolution each to complete an longitudinal (up or down) movement of the sample delivery assembly (14). Two lift chains (54) are pinned at one end to the lift sprockets (50), and at the other end, to either end of a full width lift bar (56). The lift bar (56) is pin jointed to a bracket on the bottom of the sample delivery assembly (14). With the partial rotation of the head sprockets on the upward movement, the lift chains (54) wrap around the lift sprockets (50) and raise the lift bar (56).

Axial rotation of the sample delivery assembly (14) occurs simultaneously with the longitudinal movement. An axial rotation means to impart rotation of the sample delivery assembly (14) about the longitudinal axis (B) may be added to the existing longitudinal drive means of a conventional irradiator unit, which has been modified to also comprise mating helices (38, 40). The helices threadedly guide the sample delivery assembly (14) in axial rotation to either withdraw or insert the sample delivery assembly within the bore (11).

Axial rotation may be imparted to the sample delivery assembly using any suitable rotation imparting means, such as the gear and spline assembly depicted in FIGS. 4 and 5. In this embodiment, a 2-way electric motor (60) is used to impart rotation to a spline shaft (62). Two thrust bearings, (64 and 66) allow concurrent rotational movement of the spline shaft (62) and the sample delivery assembly (14), and are connected by a drive chain (72) engaging two axial rotation sprockets (68 and 70). As the lift bar (56), is actuated to a raised or lowered position by means of lift sprockets (50) and chains lift (54), the first axial rotation sprocket (68) moves up and down the spline shaft (62) while rotation is driven by the spline shaft. The first axial rotation sprocket (68) is connected to the sample delivery assembly (14) via drive chain (72) and a second axial rotation sprocket (70), larger in size than the first, is attached to the bottom of the sample delivery assembly (14). However, it is to be understood that other mechanisms to impart axial rotation may also be employed.

A number of known mechanical or electrical devices or methods can be used to synchronize the longitudinal and rotational movements. Any of these devices or methods may be employed for use with the present invention. According to an embodiment of the invention, the two drive systems, namely the longitudinal drive mechanism and the axial rotation means, are electrically synchronized in such a way so that the sample delivery assembly (14) travels longitudinally by the distance of one pitch of the mating helices for each axial turn.

Use of a synchronized mechanism allows for easy movement of the helices, and is advantageous if the helices are both formed of stainless steel or other materials which would not easily move relative to each other due to frictional forces. The helices do not carry any load when the weight of the sample delivery assembly is supported by the lift bar (56) in combination with the longitudinal drive means, as shown in FIG. 4. Thus, a synchronized mechanism reduces excessive or wear on the helices, and advantageously prevents or reduces galling as a result of friction between metal surfaces, such as two stainless steel surfaces.

Figure 7:
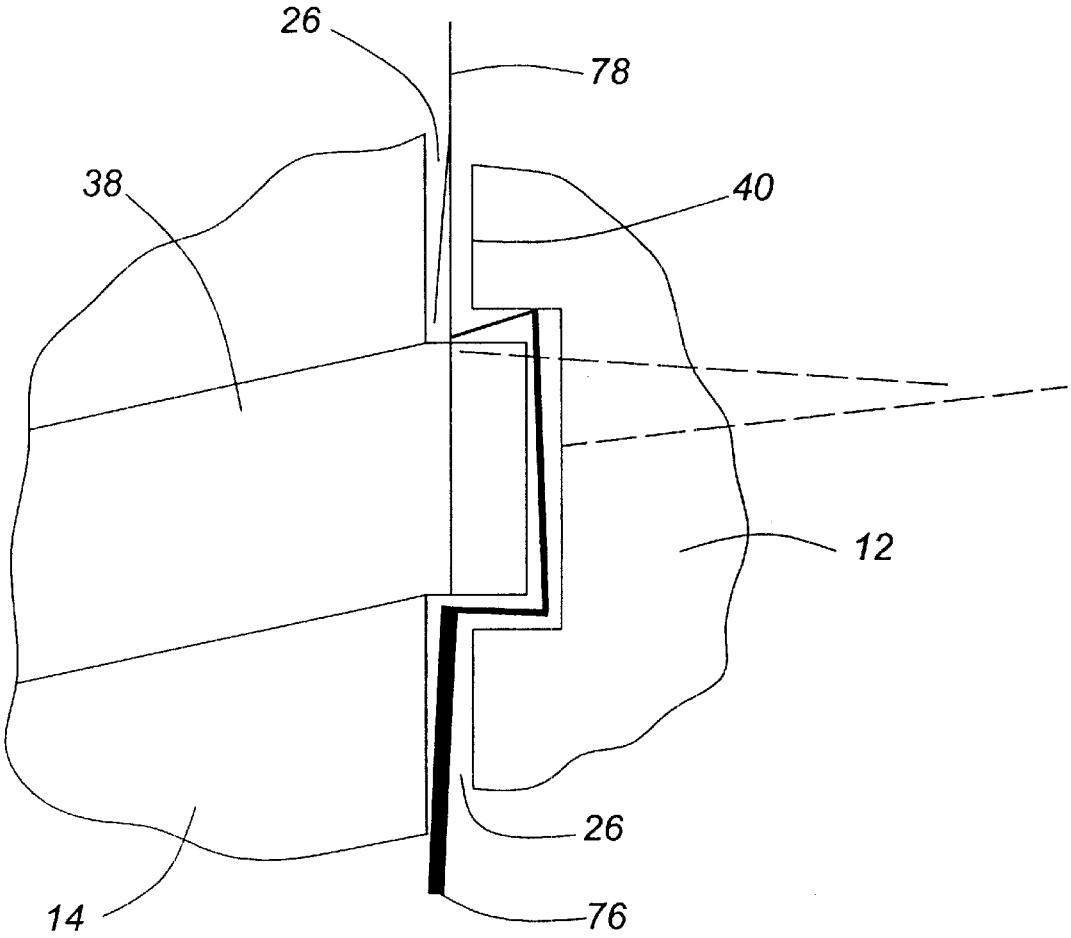
FIG. 7 is a partial sectional side view of the embodiment of FIG. 6, further illustrating the principle of radiation attenuation by transmission and scatter.

As shown in FIGS. 6 and 7, the helices (38, 40) protrude into the gap (26) between the sample delivery assembly (14) and the housing (12), providing barriers within the gap around which radiation must pass in order to escape from the gap. Radiation scatters when a barrier is encountered, and thus radiation leakage is attenuated by the helices within the gap. Providing at least one helical turn within the gap reduces radiation emanating from the radioactive source within the container. According to one embodiment of the invention, about 2 helical turns will provide sufficient radiation interference (or "step density") to reduce leakage of radiation through the gap (26) to a negligible amount. The number of helical turns (or revolutions), as well as the depth and width of the mating portion of the helices, contribute to the shielding accomplished according to the invention.

The clearance between the adjacent portions of the helices may vary, but is large enough to allow facile movement of the adjacent components of the helices. With respect to the embodiment in which the container is an irradiator unit, an air gap of from about 0.01 to about 0.3 inch, and preferably from about 0.03 to about 0.06 inch, is adequate to allow movement of the helices relative to each other. This gap could be greater and still accomplish radiation shielding, depending on the step density, number of helical revolutions, and depth and width of the helices.

The basic principle of radiation attenuation by transmission and scatter is illustrated in FIG. 7. According to the invention, a primary radiation beam (76) emanating from a radiation source (10) enters the gap (26) and encounters a "step" of the first helix (38). Part of the beam is deflected around the step through the gap (26), and part of the beam passes through the helix material. Both parts of the beam recombine on the other side of the helix step to a reduced secondary beam (78). The process is repeated at every step of the helices so that the exiting beam is reduced by several orders of magnitude in comparison to the primary radiation beam. Thus, a greatly reduced amount of radiation emanates from the gap (26) between the surface of the housing (12) and the sample delivery assembly (14).

Advantageously, the personnel installing, servicing or operating an irradiator will benefit from reduced radiation exposure according to the invention. The process of installing and servicing an irradiator unit requires personnel to reach across the gap (both above and below the unit) and thus expose their hands to the radiation emanating from the gap. In addition, a small amount of scattered (low energy) radiation from the gap may contribute to the overall total dose received by those individuals not exposed directly to the gap. Both gap exposure and overall dose received will be significantly reduced by the invention.

Loading and unloading the irradiator unit sample chamber is carried out across the gap (at the top of the irradiator unit). An individual who operates a conventional irradiator unit frequently and for extended periods may receive a significant cumulative dose to the hands. The invention will decrease the cumulative dose received.

The reduction of radiation doses leaking from the gaps in a container, for example, but not limited to a Gammacell™ 220, will improve marketability of any container housing a radioactive source while maintaining its desirable performance characteristics. For example, with an irradiator unit, the radiation dose rate and uniformity within the sample chamber are maintained, and the use of numerous accessories with the unit is still possible.

Refurbishing of the source within the irradiator requires transportation of the housing containing the source. During transport, the sample delivery assembly remains within the housing and the helices minimize radiation leakage. Further shielding may be fitted to the upper and lower openings of the bore to further reduce any radiation leakage.

Storage & Transport Container

A further embodiment of the invention wherein the container is a radiation storage and transport container is illustrated in FIGS. 8 to 10. The transport and storage container (80) has a housing (12) with and longitudinal bore (11) therein, and a lid (84). The container also comprises a removable sleeve, which in this embodiment is a source delivery assembly (88), since the assembly is adapted to house a radiation source. A chamber (20) is disposed within the source delivery assembly (88). FIG. 8 depicts a radiation storage and transport container (80) with the source delivery assembly (88) in the inserted position, and FIG. 9 depicts the container (80) with the source delivery assembly (88) in the withdrawn position. FIG. 10 relates to an alternate transport and storage container. First and second helices (38, 40), as described earlier for an irradiator unit, are located on the source delivery assembly and on the surface of the housing (12) facing into the bore (11), respectively.

The lid (84) is an optional feature of the storage and transport container (80). In the absence of a lid, the shielding provided by the helices (38, 40) reduces the radiation emanating from the gap (26) between the housing (12) and the source delivery assembly (88). The lid (84) may be formed of a shielding material to ensure further attenuation of radiation, and advantageously prevents entry of dirt or other particulate matter into the gap between the housing (12) and the source delivery assembly (88). Furthermore, the lid (84) is not required to maintain the source delivery assembly (88) in the inserted position, since rotational force must be applied to raise the source delivery assembly, and thus accidental removal of the assembly from the housing would be unlikely. The lid may screw onto the transport container, or be attached through other means known in the art.

To move the source delivery assembly (88) between a withdrawn and an inserted position, a rotation imparting means, which in this embodiment is a tab (94), is located at the top of the source delivery assembly and operates to rotate the assembly (88) about longitudinal axis (B). Several high energy applications, for example using $^{60}$Co, will require that this operation be carried out remotely, under water, or within a shielded chamber. In the embodiment depicted in FIGS. 8 and 9, the rotation imparting means may be operated manually by a worker. If the rotation imparting means is to be manually operated, it may comprise, for example, a tab, a knob, a button, a bar, a key, or any appropriate form which may be grasped by the worker, or by a tool appropriate for operation by a worker. Alternatively, the rotation imparting means may be combined with or integral to the lid, whereby rotation of the lid withdraws the source delivery assembly from the bore. The rotation imparting means may be lockable and/or removable from the source delivery assembly to allow limited access to the contents of the container. Alternatively, the rotation imparting means may be mechanically automated and associated with a lid, eye-hook, tab or suitable means.

When a radiation source is to be stored or transported within the container (80), the radiation source is inserted into the chamber (20) when the source delivery assembly (88) is in the withdrawn position shown in FIG. 9. The source delivery assembly (88) is then moved to the inserted position by applying rotational force to the tab (94), thereby rotating the source delivery assembly (88) into the bore of the housing. In this embodiment, a worker may grasp the tab (94) and apply a twisting force thereto about the longitudinal axis (B), and the helices (38, 40) guide the source delivery assembly into the bore (11) of the housing (12). One or more helical turns are located above the radiation source when in the inserted position, in order to shield the gap (26) between the housing (12) and the source delivery assembly (88). The lid (84) of the container can then be closed.

Alternatively, as depicted in FIG. 10, the storage and transport container of the present invention may also comprise a removable sleeve (108) being either a sample delivery assembly or a source delivery assembly inserted within a container (12; e.g., a shielded housing) that is adapted to receive both a plug, generally indicated as 96 and the removable sleeve (108). The internal bore of the housing may comprise a stepped bore as depicted in FIG. 10, wherein the lower portion of the bore (98) is adapted to receive the removable sleeve (108), and the upper bore (100), of an enlarged diameter, to accommodate the plug (96). However, the upper and lower portions of the bore may also be of the same diameter. The plug comprises a eye-book, tab (94) or some other device to permit removal or insertion of the plug in order to gain access to the bore and insert or remove the removable sleeve. A removal or insertion means (generally indicated as 106) imparts rotational movement to the plug during removal and insertion.

The plug (FIG. 10) comprises an integral or affixed helix (102) to its outer surface which mates with a corresponding integral or affixed helix (104) formed on the inner surface of the bore. The helix of the plug loosely mates with the helix of the bore, so that air, water or other liquid that the storage and transport container is immersed within during loading or unloading operations, may freely pass between the bore and the outside when the plug is inserted or removed. The plug may also comprise a zigzag vent tube (not shown) in order to further permit venting of air or liquid during the loading or unloading operation. The primary purpose of the mating helices of the plug and bore in this embodiment is to attenuate radiation leakage from the source, and not to seal the source within the housing. Rather the source is sealed within the source delivery assembly (108).

EXAMPLES

Comparative Example

The radiation levels of the measured outside fields of a conventional Gammacell™ 220 irradiator, having a gap length of 11 inches (about 28 cm) is up to about 500 to 1000 mR/hour, depending upon the instrumentation used for detection.

Example 1

By applying an attenuation factor to the measured outside fields, the radiation field above and below an irradiator unit having a gap which is shielded according the invention can be determined. For an irradiator unit having a gap of 11 inches in length (about 28 cm), steel helices are inserted, thereby creating a steel barrier in the gap to at least 50% of the length (about 5.5 inches or 14 cm). Applying known principles, the number of logeo reductions of primary gamma radiation (1.17 and 1.33 MeV) is estimated as negative 1.7 or a factor of 0.019. Thus, the measured field range is reduced to 9.5–19.0 mR/hour. These levels are further reduced due to deterioration of primary energy as a result of scatter.

Example 2

The reduced levels of radiation exposure realized in Example 1 can be further decreased by increasing the length of the gap. A gap of approximately 12 inches (about 30 cm) which is shielded according to the invention introduces steel to at least 50% of the gap length (6 inches or 15 cm). The field thus produced is about 8.0–16.0 mR/h.

The invention is not limited to application for improved irradiator units, or radiation storage and transport containers, but may extend to any container housing a radioactive source.

All publications cited herein are incorporated by reference. Various modifications may be made without departing from the invention. It is understood that the invention has been disclosed herein in connection with certain examples and embodiments. However, such changes, modifications or equivalents as can be used by those skilled in the art are intended to be included. Accordingly, the disclosure is to be construed as exemplary, rather than limiting, and such changes within the principles of the invention as are obvious to one skilled in the art are intended to be included within the scope of the claims.

The embodiments of the invention in which an exclusive property of privilege is claimed are defined as follows:

1. A container for accommodating a radioactive source comprising:

a shielded housing having a bore extending therein;

a removable sleeve adapted for insertion into said bore, said removable sleeve comprising a chamber for receiving a radioactive source;

said housing and said removable sleeve defining a gap formed there between when said removable sleeve is inserted into said bore;

a first helix located on a surface of said housing facing into said bore;

a second helix located on said removable sleeve, wherein said first helix loosely mates with said second helix thereby attenuating leakage of radiation from said container through said gap when said radioactive source is accommodated therein.

2. The container according to claim 1, wherein axial rotation of said removable sleeve with respect to said housing moves said removable sleeve between a withdrawn position and an inserted position within said housing.

3. The container according to claim 1, wherein said removable sleeve is a sample delivery assembly.

4. The container according to claim 3, wherein said container is an irradiator.

5. The container according to claim 1, wherein said removable sleeve is a source delivery assembly.

6. The container according to claim 5, wherein said container is a radiation storage or transport container.

7. The container according to claim 1, wherein said housing accommodates the radioactive source peripheral of said bore.

8. The container according to claim 1, wherein said chamber opens to a sidewall of said removable sleeve.

9. The container according to claim 1, wherein said bore comprises a region of expanded cross-section for receiving a radioactive source at the periphery thereof.

10. The container according to claim 9, wherein said housing is adapted to receive said radioactive source in an annular configuration within said bore in said region of expanded cross-section.

11. The container according to claim 10, wherein the first helix is interrupted in said region of expanded cross-section.

12. The container according to claim 1, said sleeve having a longitudinal axis, said container additionally comprising rotation imparting means to impart axial rotation about said longitudinal axis to said sleeve.

13. The container according to claim 12, wherein said rotation imparting means comprises a motor.

14. The container according to claim 12, wherein said rotation imparting means is manually operable.

15. The container according to claim 12, additionally comprising longitudinal drive means to impart movement to said in the direction of said longitudinal axis.

16. The container of claim 1, wherein said first and second helix are integrally formed on the surface of said housing and said removable sleeve, respectively.

17. The container of claim 1 wherein said first and second helix are affixed to the surface of said housing said removable sleeve, respectively.

* * * * *

UNITED STATES PATENT AND TRADEMARK OFFICE

CERTIFICATE OF CORRECTION

PATENT NO. : 6,452,200 B1
DATED : September 17, 2002
INVENTOR(S) : Jiri G. Kotler It is certified that error appears in the above-identified patent and that said Letters Patent is hereby corrected as shown below:

Title page,
Item [74], delete "Brink" and substitute -- Brinks -- in its place.

Column 12,
Line 41, insert -- sleeve -- before "in the direction".

Signed and Sealed this

Twenty-fourth Day of June, 2003

JAMES E. ROGAN
*Director of the United States Patent and Trademark Office*